United States Patent [19]

Rakov

[11] Patent Number: 4,540,271

[45] Date of Patent: Sep. 10, 1985

[54] ELECTROPHOTOGRAPHIC APPARATUS HAVING IMPROVED, FIXED-CONTACT GROUNDING STRUCTURE

[75] Inventor: David M. Rakov, Rochester, N.Y.

[73] Assignee: Eastman Kodak Company, Rochester, N.Y.

[21] Appl. No.: 509,081

[22] Filed: Jun. 29, 1983

[51] Int. Cl.[3] ..... G03G 15/00

[52] U.S. Cl. ..... 355/3 R; 361/220

[58] Field of Search ..... 355/3 R, 16, 133, 3 CH; 361/212, 220

[56] References Cited

U.S. PATENT DOCUMENTS 3,533,692 10/1970 Blanchette et al. ..... 355/16

3,552,957 1/1971 Hodges ..... 96/1.5

3,910,475 10/1975 Pundsack et al. ..... 226/6

4,120,720 10/1978 Gross ..... 96/1.5

4,344,698 8/1982 Zeman ..... 355/16

*Primary Examiner*—R. L. Moses

*Attorney, Agent, or Firm*—John D. Husser

[57] ABSTRACT

A device for coupling the conductive layer of a film-type photoconductor sheet to a source of reference potential includes a plurality of sharp, vitreous carbon particles which are attached to an engaging member and electrically coupled to a source of reference potential, e.g. ground. The engaging member is adapted to urge the particles to penetrate the photoconductive insulator layer and form a low resistance, ohmic contact with the conductive layer of the photoconductor sheet.

5 Claims, 4 Drawing Figures

ELECTROPHOTOGRAPHIC APPARATUS HAVING IMPROVED, FIXED-CONTACT GROUNDING STRUCTURE

BACKGROUND OF THE INVENTION

1. Field of the Invention

The present invention relates to electrophotographic apparatus and more particularly to structure for establishing a reference potential (e.g. ground potential) on the photoconductor image member of such apparatus.

2. Description of the Prior Art

The photoconductor image members of electrophotographic apparatus generally include a photoconductive insulator layer overlying a conductive surface. One common image member type is in the form of an electrically conductive drum having an inorganic photoconductor surface, and the establishment of reference potential (e.g. by grounding the drum) presents no difficulties. However, it is becoming increasingly popular to form the photoconductor image member as a film which includes a conductive layer sandwiched between an electrically insulative support and an organic photoconductive insulator layer. With this image member configuration it is more difficult to establish reference potential because the conductive layer is not readily accessible for electrical contact.

Many alternative approaches have been developed for grounding such film-type photoconductor image members. The desirability of a particular one of the approaches for a given apparatus application depends significantly upon factors such as the photoconductor film format (e.g. sheet, web or endless belt), the degree of quality required and whether the photoconductor film is to be reused. For example, U.S. Pat. No. 4,344,698 discloses a useful technique for grounding a non-reusable photoconductor film web that moves through process stations, between a supply and take-up roll. The '698 moving contact grounding approach is to cut through the edge of the successive photoconductor layer portions so that underlying conductive layer portions are contacted by the grounded cutting blade. U.S. Pat. Nos. 3,533,692 and 3,552,957 disclose a fixed-contact grounding approach for film-type image members in sheet format, which involves attaching electrically conductive clamps, straps or rivets to an exposed portion of a conductive interlayer. U.S. Pat. No. 4,120,720 discloses another fixed-contact approach for sheet format film. In that approach holes are cut through the cross-section of the sheet and treated with conductive laquer to enable subsequent contact with an electrically conductive grounding pin of electrophotographic apparatus.

The prior art fixed-contact grounding approaches require special fabrication procedures, and this adds cost. It therefore would be desirable to have a simpler approach (e.g. similar to the cutting technique disclosed in the '698 patent) for the fixed-contact grounding of film-type image members in sheet format.

SUMMARY OF THE INVENTION

Thus, one important purpose of the present invention is to provide, in electrophotographic apparatus, improved structure for effecting fixed-contact electrical referencing of a film-type photoconductor member. The approach of the present invention is particularly useful with film-type photoconductor image members of sheet format.

One advantage of the present invention is the simplicity of its construction and operation. Another advantage of the present invention is that it requires no special fabrication of cooperative photoconductor image members. Another advantage of the present invention is its effectiveness with various photoconductor image member materials in both negative and positive primary charged modes. A further advantage of the present invention is its durability for repeated, reliable groundings in a manner that imparts little damage to the imaging member.

The present invention provides in electrophotographic apparatus of the type adapted for use with a film-type photoconductor image member an improved device for fixed-contact coupling of such member's conductive layer to a source of reference potential. In one aspect the device includes an engaging member which supports a plurality of sharp, electrically conductive probe elements that are electrically coupled to a source of reference potential. In one preferred embodiment the engaging member is mounted for movement into and out of engagement with an imaging member as well as along the operative imaging path and the device includes means for urging engaging member into engagement with such photoconductor imaging member so that conductive probe elements penetrate into electrical contact with its conductive layer. In an especially preferred embodiment the conductive probe elements are vitreous carbon particles that have a maximum dimension less than about 1 mm and have a maximum particle size distribution range no greater than about 0.2 mm.

DESCRIPTION OF THE DRAWINGS

The subsequent description of preferred embodiments of the invention refers to the attached drawings wherein.

DETAILED DESCRIPTION OF THE PREFERRED EMBODIMENTS

Figure 1:
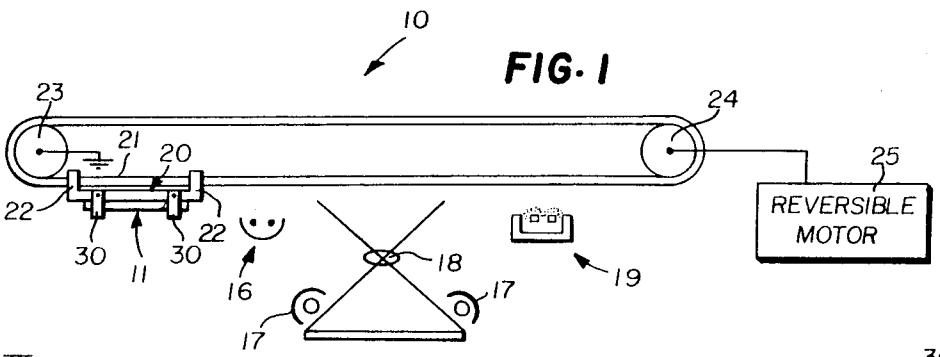
FIG. 1 is a schematic side view of an electrophotographic apparatus incorporating one preferred embodiment of the present invention.
Figure 3:
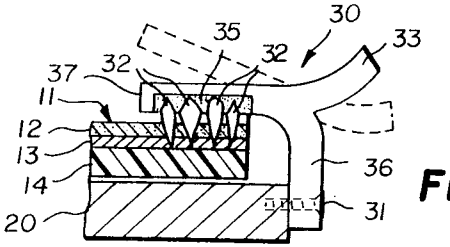
FIG. 3 is a cross-section taken along the line III—III of FIG. 2.
Figure 2:
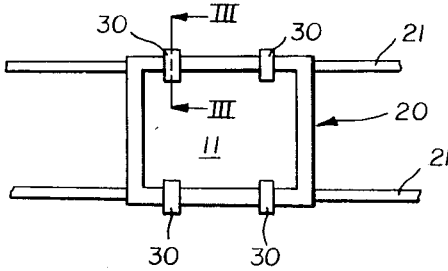
FIG. 2 is a bottom view of a portion of the FIG. 1 apparatus.

FIGS. 1, 2 and 3 illustrate one exemplary electrophotographic apparatus 10 which can employ the advantages of the present invention. As shown in those Figures, apparatus 10 is adapted to utilize a film-type, sheet format photoconductor imaging member 11 which includes a photoconductive insulator layer 12 overlying an electrically conductive layer 13 on an insulative film support 14. The apparatus 10 includes a primary charging station (denoted by corona discharge device 16), an exposure station (denoted by illumination sources 17 and lens 18) and a development station (denoted by liquid development device 19). The apparatus 10 also includes a grounding and transport means, including a metal platen 20, which is constructed to operatively receive and support a photoconductor image member sheet 11 and transport it along the operative apparatus path, past the charging, exposure and development stations.

Platen 20 is mechanically and electrically coupled to endless metal drive cables 21 by platen legs 22. The cables 21 are mounted on idler and drive pulleys 23 and 24. Idler pulley 23 is electrically conductive and couples the cables 21 to a reference potential source, e.g. ground potential. Drive pulley is coupled to suitable drive means, e.g. reversible motor 25, and effects movement of the platen 20 back and forth past the operative electrophotographic stations via the cables 21.

Mechanically and electrically connected to platen 20 are a plurality of sheet coupling devices designated generally 30. The construction details of one preferred embodiment of coupling device 30 can be seen in more detail in FIG. 3; however it is to be noted that, for illustrative clarity, the size of certain portions of FIG. 3 are enlarged far beyond proper relative scale. As shown in FIG. 3, the coupling device 30 comprises an "L"-shaped, engaging member with one arm 36 electrically and mechanically connected to platen 20, e.g. by screw 31, so that the other, contact, arm 37 extends over the edge of a photoconductor sheet positioned on platen 20. Onto the surface of arm 37 that opposes the photoconductor sheet are attached (e.g. by conductive adhesive 35) a plurality of sharp-pointed, electrically conductive probe elements 32.

The engaging member has a tab 33 that can be forced downwardly (to the dotted line position in FIG. 3), and the overlying arm 37 then moves to a spaced position (also dotted in FIG. 3) relative to the photoconductor 11. The engaging member is designed so that its resilient restoring forces will move it into the solid line position shown in FIG. 3, when tab 33 is released. As shown, in the released position, the probe elements penetrate through the photoconductive insulator layer of photoconductor image member 11 and into (or through) the electrically conductive layer 13. This effects a reliable electrical coupling of the layer 13 of a received film-type photoconductor sheet to the apparatus reference potential, e.g. ground potential.

Preferred constructions for the probe elements 32 will be described in more detail; however, first, a brief description of an exemplary imaging cycle of apparatus 10 completes the environmental setting of the invention. In operation, a photoconductor image member sheet 11 is mounted on platen 20 and the members 30 are moved to engage the sheet edge as shown in FIGS. 2 and 3. The platen 20, with its supported and grounded sheet, is then moved by cables 21 past corona discharge device 16 where layer 12 receives a uniform overall primary electrostatic charge. Platen 20 next moves past the exposure station where the photoconductor image member is imagewise discharged, through conductive layer 13 and the grounding device of apparatus 10. The platen 20 next moves past developing device 19 where toner is applied to develop the electrostatic image. The developed image can then be dried on the sheet 12 and the sheet removed for use. The motor 25 is then reversed and platen 20 returned to the original position to commence another imaging cycle.

In constructing an electrical coupling device in accord with the present invention, there are several important parameters to consider with respect to the selection of the piercing particles 32. First, it is important that the probe elements make a low-resistance, ohmic connection with the photoconductor's conductive layer. Various conductive metal particles are useful for this purpose; however, I have found vitreous carbon particles to be preferable from the viewpoint of maintaining a non-rectifying, grounding contact with a variety of photoconductors in both polarity modes of operation (i.e. with positive or negative primary charge). Secondly, it is highly preferred that the probe elements be durable, i.e. remain sharp over extended periods of use with a large number of photoconductor sheets. Again vitreous carbon particles perform admirably in this regard. Thirdly, it is important that a sufficient number of probe elements operably pierce the conductive layer to transmit operative electrical current. Useful numbers of the vitreous carbon particles will depend on the particle size (and thus the contact surface area) and on the current to be carried.

Although the desired size of particles depends on the photoconductor thickness which is to be penetrated and the extent which the particles protrude from their support, I have found it highly preferred to use particles having a maximum dimension less than about 1 mm, because shape variations of larger particles often prevent some particles from obtaining contact. Also, it is highly preferred that the piercing particles have a fairly narrow size distribution range so that a maximum number of particles in the group effect electrical contact. A highly preferred particle size distribution range is about 0.20 mm. Particularly preferred sizes are from about 0.15 to 1.00 mm with a group distribution range of maximum particle size of about 0.20 mm. These particle sizes work well with most common photoconductor films including those described below.

The following examples further illustrate preferred construction and grounding techniques in accord with the present invention.

EXAMPLE I

To form a grounding device, pieces of vitreous carbon in the form of evaporation containers that are commercially available from Fluorocarbon, Process Systems Division, (P.O. Box 3640, 1432 S. Allec Street, Anaheim, Calif. were reduced in size to approximately 1 to 2 mm. This was done by pulverizing large pieces of the containers and collecting the particles left after sifting on a 1 mm mesh screen. These carbon particles were assembled to form a probe similar to open coat sandpaper by attaching them to a 5 mm×5 mm square of 0.28 mm thickness brass using a conducting silver epoxy adhesive.

Another probe was made in a similar manner from carbon particle approximately 0.5 to 1 mm in size by sifting the small residue on a 0.5 mm mesh screen.

The vitreous carbon probes described above were used to make low resistance, ohmic contact with the conducting layer of Ektavolt Recording Film Type SO-102 and with multilayer, aggregated photoconductor films.

In all cases, probes were tested at both polarities. Electrical contact to the conductive layer was made by manually pressing the probe against the photoconductor surface causing the sharp edged carbon particles to penetrate the photoconductor layer. In both cases this procedure resulted in low resistance, ohmic contact with the conductive layer of the photoconductor.

EXAMPLE II

Another probe, made in the same manner with the less than 0.5 mm particle size fraction, was tested with a reusable, aggregated, organic photoconductive film.

The probe was held in place by a mass of 5 kg. An additional brief force supplied by a light blow from the hand was needed to cause probe penetration to the conducting layer. The resulting voltage variation as a function of current indicated a low resistance, ohmic contact.

EXAMPLE III

In an effort to increase the number of sharp edges and points sticking out from the probe, the following preparatory technique was devised. Vitreous carbon particles with a narrow size distribution were poured onto a screen, to form a single layer of particles. Many particles settled with points facing down through the screen and about $\frac{1}{2}$ their dimension above and below. The conducting epoxy adhesive described above was coated on a brass substrate and this tacky substrate was brought into contact with the layer of carbon particles on the screen. The carbon particles with maximum particle sizes of 0.1 mm to 0.3 mm were adhered to the brass when the brass and screen were separated. Tests of the 0.1–0.3 mm particle size probe using the film and test conditions similar to those in Example I resulted in an observed contact voltage drop of $<0.1$ volts at 3 $\mu$A with significantly reduced force applied—a mass of 280 gm. This again indicated a low resistance, ohmic contact.

As indicated above vitreous carbon particles have been found to perform conductive layer grounding with great success. Probes using these particles can be formed in various ways in accord with the present invention. The vitreous carbon material itself is known in the art and the form preferred for the present invention is a glassy, isotropic, electrically conductive form that is very hard (e.g. 7 moh). It is prepared by heating organic polymers to a high temperature (e.g. 1800° C.). The material is susceptible to molding prior to vitrification so that probes with more uniform profiles can be fabricated in that manner.

Figure 4:
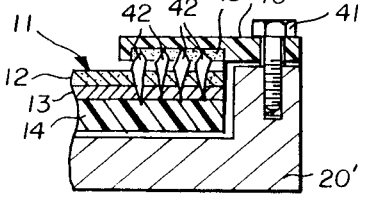
FIG. 4 is a cross-sectional view similar to FIG. 3 but illustrating an alternative preferred embodiment of the present invention.

FIG. 4 illustrates an alternative preferred embodiment in accord with the present invention. In this embodiment electrically conductive platen 20' is configured with an "L"-shaped edge to position a received sheet 11 and engaging member 40 is mechanically connected to platen 20' by screw 41. In this mode the screw can be tightened to urge penetration of the piercing particles 42 which are attached to the under surface of member 40 by conductive adhesive 45. The engaging member can be electrically conductive or a separate electrical lead (not shown) can be provided between the conductive adhesive and the platen 20'. Various spring-loaded devices can be devised by those skilled in the art to provide a predetermined force tailored to the photoconductor layer thickness and hardness and the particle size.

Although vitreous carbon is highly preferred for its bipolarity, non-rectifying contact characteristics, other conducting substrates and conductive adhesives can be used to form the probes of this invention, such as, for example, aluminum, copper, silver or gold. Gold and Paliney-7 (an alloy made by the Ney Co.) were also used to make probes that made non-rectifying contact with the photoconductor film; however, these were much less wear resistant than the vitreous carbon. The gold probe was made by evaporation onto steel probe elements.

The invention has been described in detail with particular reference to preferred embodiments thereof, but it will be understood that variations and modifications can be effected within the spirit and scope of the invention.

What is claimed is:

1. In electrophotographic apparatus of the type having an operative electrographic path and constructed to mount and move a photoconductor image sheet, which includes a photoconductive insulator layer overlying a conductive layer on an insulative support, along such path, a device for coupling such conductive layer to a source of reference potential, said device comprising:

(a) an engaging member having a support portion;

(b) a plurality of sharp, electrically conductive probe elements consisting of vitreous carbon particles which are structurally coupled to said support portion and electrically coupled to a source of reference potential;

(c) means for mounting said engaging member for movements such that: (1) said probe elements are movable into and out of a low resistance, ohmic contact with the conductive layer of such an image sheet and (2) said engaging member and said probe elements are movable along the operative path of said apparatus with a contacted image sheet; and (d) means for urging said engaging member in a direction such that said probe elements will penetrate into electrical contact with such conductive layer.

2. The invention defined in claim 1 wherein said probe elements are vitreous carbon particles have a maximum dimension less than about 1 mm.

3. The invention defined in claim 2 wherein said support portion comprises electrically conductive adhesive.

4. The invention defined in claim 2 wherein said particles have a maximum dimension in the range from about 0.15 mm to about 1 mm.

5. The invention defined in claim 4 wherein the maximum particle size distribution range of said particles is no greater than about 0.20 mm.

* * * * *